United States Patent [19]

Likens

[11] Patent Number: 4,995,330

[45] Date of Patent: Feb. 26, 1991

[54] DELIVERY BOX SIGNALING ARRANGEMENT

[76] Inventor: Billy G. Likens, 5800 Plainview Dr., Evansville, Ind. 47712

[21] Appl. No.: 425,037

[22] Filed: Oct. 23, 1989

[51] Int. Cl.[5] ..... G09F 17/00; B65D 91/00

[52] U.S. Cl. ..... 116/175; 232/34

[58] Field of Search ..... 116/175; 232/34, 35, 232/37

[56] References Cited

U.S. PATENT DOCUMENTS

| | | | |
|---|---|---|---|
| 2,496,962 | 2/1950 | Shaw | 232/34 |
| 3,275,228 | 9/1966 | Golla | 232/34 |
| 3,960,316 | 6/1976 | Echterling | 116/215 |
| 4,063,681 | 12/1977 | Tong | 232/34 |
| 4,382,541 | 5/1983 | Miller | 232/35 |
| 4,771,941 | 9/1988 | Bowman et al. | 232/35 |
| 4,877,180 | 10/1989 | Shull | 232/35 |

*Primary Examiner*—William A. Cuchlinski, Jr.
*Assistant Examiner*—W. Morris Worth
*Attorney, Agent, or Firm*—Warren D. Flackbert

[57] ABSTRACT

A signaling arrangement for a remotely located delivery box, such as one used for receiving newspapers, presenting a control plate assembly movable from a first position to a second signaling position upon placement of an article in the box. The control plate assembly includes a signal plate on a portion thereof and a free end cooperable with a latching element affixed to the box for maintaining the control plate assembly at an article awaiting condition. In other words, simple pivotal action signals the presence of a delivered article.

4 Claims, 1 Drawing Sheet

DELIVERY BOX SIGNALING ARRANGEMENT

As is known, the usage of a delivery box, such as the type used for receiving newspapers, is quite common and widespread. A problem associated with such a delivery box arises in location, i.e. the box is generally remote and/or distant from a residence and, in rural areas, adjacent a highway delivery route. By reason of the aforesaid location, it is difficult for the delivery box owner to know whether or not a delivery has been made without traveling to and from the box, the latter providing a particular hardship in inclement weather and/or in view of the owners age or physical capabilities.

BACKGROUND OF THE INVENTION

The invention solves the preceding problem by presenting a delivery box which includes a simple arrangement for signaling the presence of a delivery, such as a newspaper. Basically, the invention is in the form of a normally upstanding control plate assembly including a control plate mounted on a pivotal strip having a rearwardly extending portion at right angles therewith. Pivotal rotation, upon placement of an article within the box, causes the strip to move to a vertically extending position beneath the box which is readily visible/observable at a distance. In order to simplify the inspection procedure even further, a colored or luminous signal plate is affixed to the strip.

When the article is removed from the box, the control plate assembly is pivoted back to its normal upstanding position and retained at such, i.e. until receipt of another article, by securing means, such as a magnet, affixed on the box and cooperable with the free rear end of the strip.

BRIEF DESCRIPTION OF THE FIGURES

In any event, a better understanding of the present invention will become more apparent from the following description taken in conjunction with the accompanying drawing, wherein.

Figure 1:
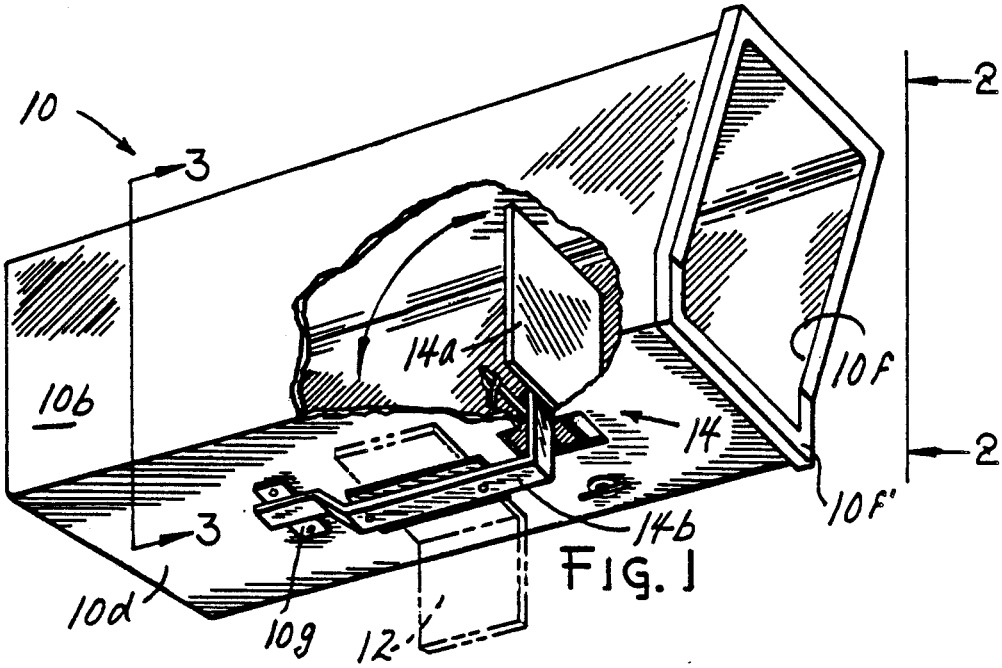
FIG. 1 is a perspective view showing a delivery box signaling arrangement in accordance with the teachings of the present invention.
Figure 3:
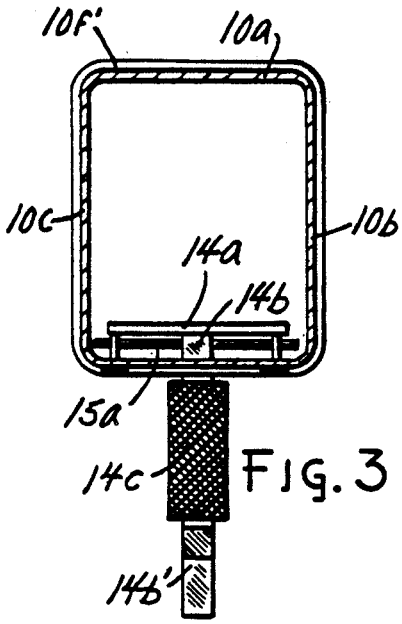
FIG. 3 is a view in vertical section looking through the delivery box at an opposite end, taken at line 3—3 on FIG. 1 and looking in the direction of the arrows; and, FIG. 4 is another perspective view showing a typical mounting arrangement for the pivotal control plate assembly.
Figure 2:
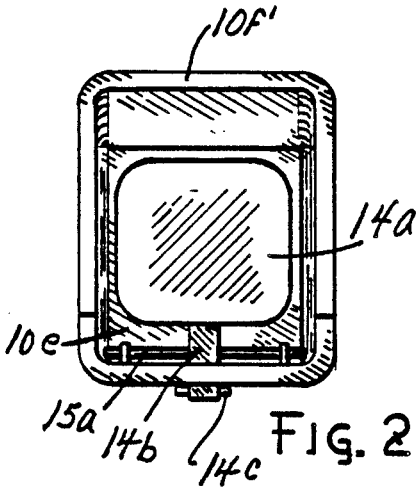
FIG. 2 is an end view of the instant invention, taken at line 2-2 on FIG. 1 and looking in the direction of the arrows.

For the purposes, of promoting an understanding of the principles of the invention, reference will now be made to the embodiment illustrated in the drawing and specific language will be used to describe the same. It will nevertheless be understood that no limitations of the scope of the invention is thereby intended, such alterations and further applications of the principles of the invention as illustrated therein being contemplated as would normally occur to one skilled in the art to which the invention relates.

Referring now to the figures, a delivery box 10 used with the invention typically includes a top wall **10*a* blending into side walls 10*b*, 10*c* which in turn blend into a bottom wall 10*d*, a back wall 10*e* and an open front or entry 10*f* edged by a rim 10*f'*. Provision is made for mounting the delivery box 10 on a standard (not shown) supported on a receiving surface through bracket 12 (shown in phantom in FIG. 1**).

The instant signaling arrangement is defined by a control plate assembly 14, typically lying in a generally upstanding or vertical position while awaiting article entry into the delivery box 10. The control plate assembly 14 includes a control plate **14*a* secured to a strip 14*b* which extends downwardly and then rearwardly in the direction of the longitudinal axis of and below the box 10**.

Figure 4:
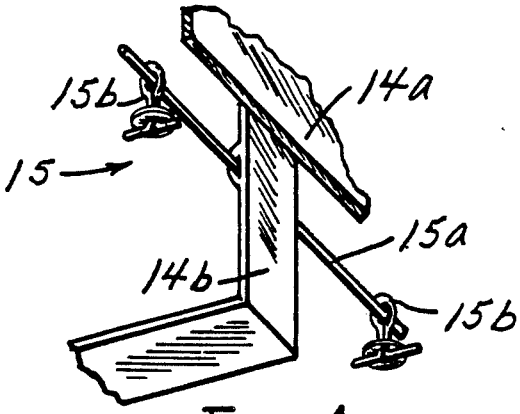

The pivoting of the control plate assembly 14 is accomplished through a sub-assembly 15 defined as a shaft **15*a*, secured to mounting strip 14*b*, and pivotal in clips 15*b* extending through bottom wall 10*d* of the box 10, where ends of the clips are outwardly turned in a securing relationship (see FIG. 4). In other words, shaft 15*a* pemits pivotal movement of strip 14*b* and, thus, achieves the pivoting of control plate 14*a***.

The assembly of the shaft **15*a* and the strip 14*b* can be accomplished as shown in FIG. 4, or, for example, by use of a separate overlying strip, riveted into position, and secured to the shaft 15*a* for movement with the strip 14*b*. In other words, strip 14*b* can freely pivot on shaft 15*a* or may pivot with shaft 15*a***.

The rearwardly extending portion of strip **14*b* mounts a signal display plate 14*c*, which, for example, may be luminous (to attract attention by a flashlight beam) or colored for ready notice. The free rear end 14*b'* of strip 14*b* typically includes an upwardly disposed dog-leg which serves to selectively latch against a locking plate 10*g*, such as a magnet, affixed to the outer surface of the bottom wall 10*d* of box 10**.

In use, the control plate assembly 14 is maintained in the desired upstanding position by reason of locking plate **10*g*, such serving to retain the dog-leg of strip 14*b* in position. When the article is placed in the delivery box 10, the control plate assembly 14 pivots, readily causing the signal/display plate 14*c*** to become visible by extending vertically, even at a considerable distance from a residence or other watching location.

Thus, it should be evident that the invention presents a simple yet effective arrangement for acknowledging the arrival of an article in a remotely located delivery box. The simple sliding force provided by the deposited article results in signaling action, where return of the pivotal control plate assembly to a normal pre-delivery position is effectively maintained, for example, by a (magnetic) securing plate affixed to the box cooperable with the free rear end of the strip presented by the pivotal control plate assembly.

The delivery box signaling arrangement described above is susceptible to various changes within the spirit of the invention, including, by way of example, in proportioning; the precise manner of achieving pivotal action for the control plate (in addition to those already discussed); the use of other than a magnetic plate for securing the control plate assembly in a pre-delivery article position; the shape of the signal plate; the optional non-use of the signal plate **14*c* (where the visible presence of the strip 14*b* would serve the same purpose); the absence of the control plate 14*a* (where the strip 14*b*** would serve the same purpose (but without, perhaps, the desired area coverage); and, the like.

Thus, the preceding should be considered illustrative and not as limiting the scope of the following claims:

I claim:

1. A signaling arrangement for a delivery box including a bottom wall comprising a control plate assembly pivotably mounted within said delivery box and operatively responsive to the placement of an article into said box, where said control plate assembly includes a strip having a forward portion within said box and a rearwardly extending portion below said bottom wall of said box, where said forward portion and said rearwardly extending portion of said strip are selectively vertical with respect to said bottom wall of said box, where a free rear end of said rearwardly extending portion of said strip selectively cooperates with securing means on said bottom wall of said box and releasably maintains said control plate assembly at a predelivery location, where placement of said article releases said free rear end and causes said strip to pivot from an article blocking position to a signaling position, where a control plate is mounted on said strip within said box in a blocking relationship with said article, and where a signal plate is mounted on said rearwardly extending portion of said strip below said box and between said rear free end and said forward portion thereof.

2. The signaling arrangement of claim 1 where said rearwardly extending portion of said strip is in the longitudinal direction of said box.

3. The signaling arrangement of claim 1 where said signal plate is luminous.

4. The signaling arrangement of claim 1 where said signal plate is colored.

* * * * *